United States Patent [19]

Morishita et al.

[11] Patent Number: 4,855,610

[45] Date of Patent: Aug. 8, 1989

[54] STARTING ELECTRIC MOTOR

[75] Inventors: Akira Morishita; Toshinori Tanaka; Shuzoo Isozumi, all of Hyogo, Japan

[73] Assignee: Mitsubishi Denki Kabushiki Kaisha, Tokyo, Japan

[21] Appl. No.: 229,527

[22] Filed: Aug. 8, 1988

[30] Foreign Application Priority Data

Aug. 7, 1987 [JP] Japan ..... 62-198590
Aug. 7, 1987 [JP] Japan ..... 62-198591
Aug. 8, 1987 [JP] Japan ..... 62-198569

[51] Int. Cl.[4] ..... F02N 15/06
[52] U.S. Cl. ..... 290/48; 74/7 A
[58] Field of Search ..... 290/39 R, 48; 74/7 R, 74/7 A, 7 B; 123/179 R, 179 M

[56] References Cited

U.S. PATENT DOCUMENTS 4,325,625 4/1982 Wakatsuki et al. ..... 74/7
4,404,533 9/1983 Kurihari et al. ..... 335/131
4,507,978 4/1985 Tanaka et al. ..... 74/7 E
4,613,761 9/1986 Yabunaka ..... 290/36 R
4,627,299 12/1986 Mortensen, Sr. ..... 74/7 A
4,665,320 5/1987 DeBello ..... 290/48

FOREIGN PATENT DOCUMENTS 0115852 8/1984 European Pat. Off. .
61-223269 10/1986 Japan ..... 290/48

*Primary Examiner*—William M. Shoop, Jr.
*Assistant Examiner*—W. E. Duncanson, Jr.
*Attorney, Agent, or Firm*—Sughrue, Mion, Zinn, Macpeak & Seas

[57] ABSTRACT

In a starting electric motor comprising: a movable pinion cylinder slidably mounted on the extension of the output shaft of the motor, the movable pinion cylinder having the front end portion formed into a pinion part, the rear end portion formed into a clutch inner part of an overrunning clutch, and the middle portion formed into a slidably supporting surface held by a first bearing fitted in the front frame, the shaft extension being supported by the front frame through the movable pinion cylinder, the movable pinion cylinder is slidably and rotatably supported on the shaft extension by a second bearing fixedly fitted in an inner cylindrical wall which is extended in the movable pinion cylinder from the clutch inner part to the middle portion with a gap relatively large between the inner cylindrical wall and the shaft extension.

9 Claims, 3 Drawing Sheets

STARTING ELECTRIC MOTOR

BACKGROUND OF THE INVENTION

1. Field of the Invention

This invention relates to starting electric motors, and more particularly to an overhang type starting electric motor for starting the engine of a vehicle.

2. Prior Art

An over-hang type starting electric motor for starting the engine of a vehicle is well known in the art, as disclosed for instance by Japanese Utility Model Application Publication No. 6679/1986.

The specific feature of the structure of an overhang type starting electric motor is, in general, as follows: As is apparent from FIGS. 1 and 2 showing the over-hang type starting electric motor disclosed by the aforementioned Japanese Utility Model Application Publication No. 6679/1986, a front frame 1 has an opening 2, through which an extension 3 of an armature rotary shaft of a DC motor (not shown) provided inside the frame is extended outwardly, and a movable pinion cylinder 4 is fitted through bearings 5 on the extension 3 in such a manner that the pinion cylinder 4 is movable axially and is rotatable around the extension 3. The pinion cylinder 4 is rotatably and slidably supported by a bearing 6 arranged inside the frame 1 and near the opening 2, thus supporting the extension 3 of the armature rotary shaft (hereinafter referred to as "a shaft extension 3", when applicable).

In the starting electric motor, the outer wall of the front end portion (on the side of the opening in the frame) of the pinion cylinder 4 is formed into a pinion 4*a*, and the rear end portion is formed into a clutch inner 7*a* which is a part of an overrunning clutch device 7. The outer wall of the middle part of the movable pinion cylinder 4, which is located between the pinion 4*a* and the clutch inner 7*a* is a supporting surface 4*b* in slide contact with the bearing 6 so that the movable pinion cylinder 4 is supported while sliding on the bearing 6.

In FIGS. 1 and 2, reference character 7*b* designates a clutch outer of the overrunning clutch device 7; 7*c*, rollers for transmitting torque from the clutch outer 7*b* to the clutch inner 7*a*; 8, an oil seal; 9, a dust protective cap detachably mounted on the front end of the movable pinion cylinder 4; 10, a stopper secured to the end of the shaft extension 3 to prevent the pinion cylinder 4 from coming off the shaft extension 3; and 11, a ring gear of the engine.

The operation of the starting electric motor thus constructed will be briefly described.

When the overrunning clutch device 7 is moved in the forward direction (or in the direction of the arrow 12) by a shift lever (not shown), the movable pinion cylinder 4 is slide on the shaft extension 3, as a result of which, as shown in FIG. 2, the pinion 4*a* comes outside the frame 1 through the opening 2 to engage with the ring gear 11. A power switch for the DC motor is turned on immediately before the pinion 4*a* engage with the ring gear 11. As a result, torque is transmitted from the armature rotary shaft through the clutch outer 7*b* of the overrunning clutch device 7 and the rollers 7*c* to the clutch inner 7*a*, so that the pinion cylinder 4 is rotated. The rotation of the pinion cylinder 4 is transmitted through the pinion 4*a* and the ring gear 11 to the engine to start the latter.

After the engine is started in this way, the movable pinion cylinder 4 may be rotated at high speed by the engine before returning to the original position. In this case, the clutch inner 7*a* of the overrunning clutch device 7 is rotated at higher speed than the clutch outer 7*b*. Therefore, the function of transmitting torque in one way of the overrunning clutch device 7 is exercised so that the rollers 7*c* are disengaged from both of the clutch inner 7*a* and the clutch outer 7*b*. As a result, the high speed rotation of the pinion cylinder 4 will not transmitted to the DC motor.

On the other hand, in the conventional starting electric motor, both end portions of the movable pinion cylinder 4 are used as the clutch inner 7*a* and the pinion 4*a*, and the middle portion is employed as the slidably supporting surface 4*b*, and therefore the pinion cylinder 4 is relatively long. In order to allow the long pinion cylinder 4 to stably slide on the shaft extension 3 and to sufficiently support the shaft extension 3, two bearings 5 are positioned on the inner cylindrical wall of the pinion cylinder 4 near both ends.

Recently, in order to increase the torque of the ring gear 11, it is intended to make the pinion 4*a* smaller in the art. If the tooth form of the pinion 4*a* is made smaller or the number of teeth is reduced, then the thickness m of the teeth base of the pinion 4*a* is reduced to less than the necessary value, because the bearing 5 is disposed on the inner cylindrical wall of the pinion 4*a*. Therefore, the pinion 4*a* may be damaged.

Furthermore, in the conventional starting electric motor, the grease applied for the bearings provided on the inner cylindrical wall of the movable pinion cylinder 4 is removed by the reciprocation of the movable pinion cylinder, and the service lives of the bearings are shortened as much.

Further more, in the conventional starting electric motor, the cap 9 is put on the front end of the movable pinion cylinder 4 as shown in FIG. 1 to prevent the entrance of water or dust, along the cylindrical surface of the shaft extension 3, into the movable pinion cylinder 4. However, the cap 9 secured to the end of the movable pinion may be damaged by the centrifugal force, or it may be damaged or broken being struck against the ring gear 11 of the engine when the starting electric motor is engaged with or disengaged from the engine. On the other hand, the length of the cap 9 is such that the cap 9 surrounds the front end portion of the shaft extension 3 when the movable pinion cylinder 4 is at the rearmost position as shown in FIG. 1. Therefore, when the movable pinion cylinder 4 is moved to the foremost position as shown in FIG. 2, the total length of the starting electric motor becomes considerably long, which lowers the efficiency of installation of the starting electric motor on the engine.

On the other hand, since one of the bearings 5 is positioned in the pinion cylinder 4 at the front end, the distance L between the bearing 5 and the cut-up part 3*a* of the helical spline of the shaft extension 3 is remarkably long when the pinion cylinder 4 slides. Therefore, a great bending moment is applied to the cut-up part 3*a*, so that it may be broken. Furthermore, because the front bearing is positioned on the inner cylindrical surface of the pinion 4*a* which is the front end portion of the movable pinion cylinder 4, the thickness of the teeth base of the pinion is limited, and accordingly the tooth form of the pinion or the number of teeth is limited.

SUMMARY OF THE INVENTION

An object of the invention is to provide a starting electric motor in which the tooth form of the pinion is made smaller or the number of teeth is reduced without lowering the strength of the pinion of the movable pinion cylinder.

Another object of the invention is to provide a starting electric motor which prevents the grease applied to the inner cylindrical wall of the movable pinion cylinder from being removed.

A further object of the invention is to provide a starting electric motor with dust protective means which will not increase the length of the starting electric motor.

A still further object of the invention is to provide a starting electric motor in which a bending moment applied to the extension of the armature rotary shaft is made small to prevent the extension from being broken.

The foregoing object and other objects of the invention have been achieved by the provision of a starting electric motor which, according to the invention, comprises: an electric motor for generating torque to start an engine; an overrunning clutch device axially slidably supported on a shaft extension of the armature rotary shaft of the electric motor; and a movable pinion cylinder slidably fitted on the shaft extension, the movable pinion cylinder comprising: a clutch inner part forming a part of the overrunning clutch device, the clutch inner part being at the rear end portion of the movable pinion cylinder; a pinion part including a pinion formed on the outer cylinder wall of the front end portion of the movable pinion cylinder in such a manner that the pinion is engageable with the ring gear of the engine; and a middle part between the clutch inner part and the pinion part, the middle part having the outer cylindrical wall made into a slidably supporting surface in such a manner that the movable pinion cylinder, while being rotatably supported by a first bearing fixedly fitted in a frame, is slidable axially with respect to the first bearing, the pinion part being allowed to go in and out of the frame through an opening formed therein, the movable pinion cylinder having a first inner cylindrical wall extended from the clutch inner part to at least a part of the middle part in such a manner that a relatively large gap is provided between the first inner cylindrical wall and the shaft extension, and a second inner cylindrical wall extended in the pinion part in such a manner that the second inner cylindrical wall and the shaft extension provides a minute clearance smaller than the relatively large gap, a second bearing being singly arranged in the relatively large gap in such a manner that the second bearing, together with the movable pinion cylinder, is slidably movable on the shaft extension. A seal member may be also positioned in front of the second bearing.

In the starting electric motor according to the invention, the movable pinion cylinder is sufficiently slidably and rotatably supported by the second bearing fitted in the relatively large gap which is formed between the shaft extension and the first inner cylindrical wall extended from the clutch inner part to at least a part of the middle part, while the second inner cylindrical wall extended in the pinion part is made smaller in diameter than the first inner cylindrical wall so that the clearance formed between the second inner cylindrical wall and the shaft extension is smaller than the relatively large gap mentioned above. Therefore, even if the tooth form of the pinion is made smaller or the number of teeth thereof is reduced, the thickness of the teeth base can be made sufficiently large. And the minute clearance between the second inner cylindrical wall and the shaft extension prevents the removal of the applied grease which may otherwise be caused. The seal member fitted in the relatively large gap prevents the entrance of water or dust through the small gap.

In the starting electric motor of the invention, the movable pinion cylinder is slidably and rotatably supported by one bearing fixedly fitted in the inner cylindrical surface large in diameter which is extended in the movable pinion cylinder from the clutch inner part to at least a part of the middle portion, whereby, when the movable pinion cylinder is moved, the distance between the bearing and the cut-up part of the helical spline of the shaft extension is shortened, and accordingly the bending moment applied to the cut-up part through the bearing by the movable pinion cylinder is reduced.

The nature, principle and utility of the invention will become more apparent from the following detailed description when read in conjunction with the accompanying drawings.

DETAILED DESCRIPTION OF THE PREFERRED EMBODIMENTS

Figure 1:
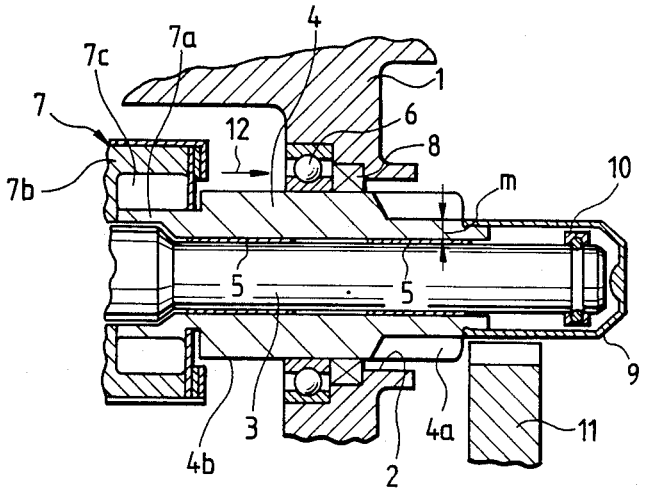
FIG. 1 PRIOR ART
FIG. 1 is a sectional view showing essential components of a conventional starting electric motor.
Figure 2:
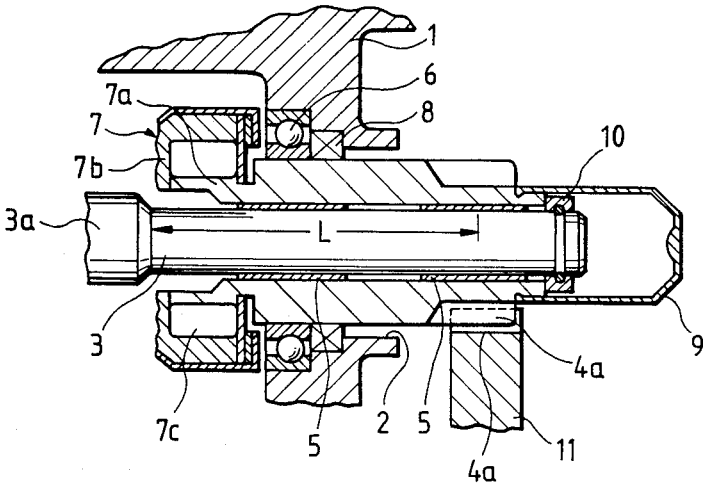
FIG. 2 PRIOR ART
FIG. 2 is a sectional view showing a conventional starting electric motor in which a movable pinion cylinder is moved to cause a pinion to engage with a ring gear of an engine.
Figure 3:
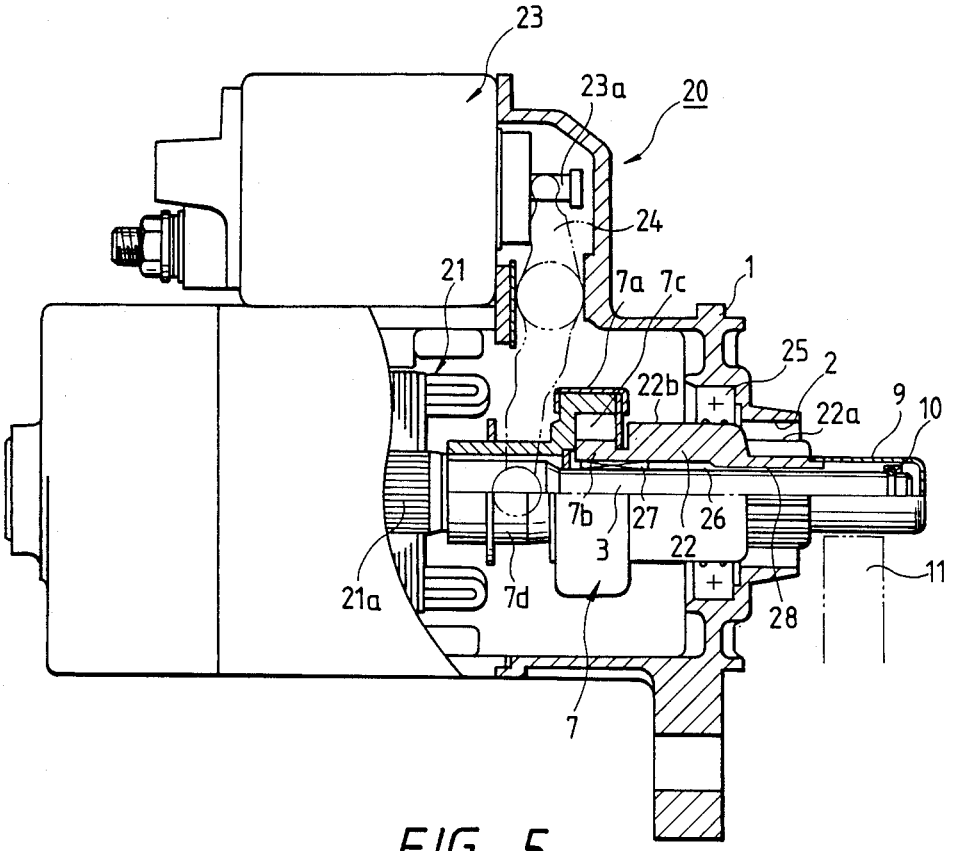
FIG. 3 is a sectional view showing starting electric motor according to an embodiment of this invention.

One example of a starting electric motor according to the invention is shown in FIG. 3, in which those components which have been described with reference to FIGS. 1 and 2 are therefore designated by the same reference numerals or characters. The starting electric motor 20 includes a DC motor 21 whose armature rotary shaft 21*a* has a shaft extension 3 which is extended in the forward direction (to the right in FIG. 3). More specifically, the shaft extension 3 is extended out of a front frame 1 through a opening 2 formed therein. An overrunning clutch device 7 is mounted on the shaft extension 3 in such a manner that it is located next to the DC motor 21.

The overrunning clutch device 7 is a conventional one. Its cylindrical part 7*d* integral with a clutch outer 7*a* is fitted on the shaft extension 3 in such a manner that it is slidable back and forth while engaging with a spline formed on the shaft extension 3. The rear end portion of a movable pinion cylinder 22, which is slidably mounted on the shaft extension 3, is formed into a clutch inner 7*b*. Therefore, the cylindrical part 7*d*, the overrunning clutch device 7, and the movable pinion cylinder 22 can be slidably moved, as one unit, on the shaft extension 3. In this operation, the force of moving these components axially (hereinafter referred to as "an axially acting force", when applicable) is provided through a shift lever 24 having one end engaged with a plunger 23*a* of an electro-magnetic switch device 23 mounted on the frame 1 and the other end in the form of a two-prong fork engaged with the cylindrical part *7d* in such a manner that the cylindrical part *7d* is held between the two prongs.

As was described above, the rear end portion of the movable pinion cylinder 22 is converted into the clutch inner *7b*. Therefore, for convenience in description, the rear end portion will be referred to as "a clutch inner part", when applicable. On the other hand, a pinion *22a* is formed on the outer cylindrical wall of the front end portion of the movable pinion cylinder 22, and therefore the front end portion will be referred to as "a pinion part", when applicable. The middle part between the pinion part and the clutch inner part has a slidably supporting surface *22b*. The slidably supporting surface *22b* is fitted in the inner lace of a ball bearing 25 fixedly fitted in the front frame 1, inside the opening 2 formed in the front frame so that the movable pinion cylinder 22 is slidably supported. The inner cylindrical wall of the major part of the movable pinion cylinder 22, from the clutch inner part to the middle part having the slidably supporting surface 22, is made larger in diameter than that of the remaining part so as to provide a relatively large gap 26 between the inner cylindrical wall and the cylindrical surface of the shaft extension 3. A bearing 27 is provided in the gap 26 to support the shaft extension 3 through the movable pinion cylinder. The bearing 27 singly provided is positioned essentially on the inner cylindrical wall of the clutch inner part of the movable pinion cylinder 22 so that it together with the movable pinion cylinder 22 is slidably movable on the shaft extension 3.

On the other hand, the inner cylindrical wall of the remaining minor part of the movable pinion cylinder 22, from the pinion part to the small part of the middle part having the slidably supporting surface *22b*, is made smaller in diameter than that of the major part thereof so as to provide a minute clearance or small gap 28 between the inner cylindrical wall of the minor part of the movable pinion cylinder 22 and the cylindrical surface of the shaft extension 3. The minute distance 28 is formed by supporting the movable pinion cylinder 22 on the shaft extension 3 through the bearing 27 which is fitted in the relatively large gap 26 provided inside the rear end portion of the movable pinion cylinder 22. Therefore, even if the tooth form of the pinion is made smaller, or the number of teeth is reduced, the thickness of the teeth base can be made sufficiently large. As the minute clearance 28 is provided inside the pinion part of the movable pinion cylinder, the labyrinth dust protective effect is obtained. This effect in association with the use of a dust protective cap 9 similar to that in the conventional starting electric motor provides an excellent dust protective effect. Furthermore, the provision of the minute clearance 28 sufficiently prevents the removal of the applied grease which may otherwise be caused by the sliding motion of the bearing 27.

Figure 4:
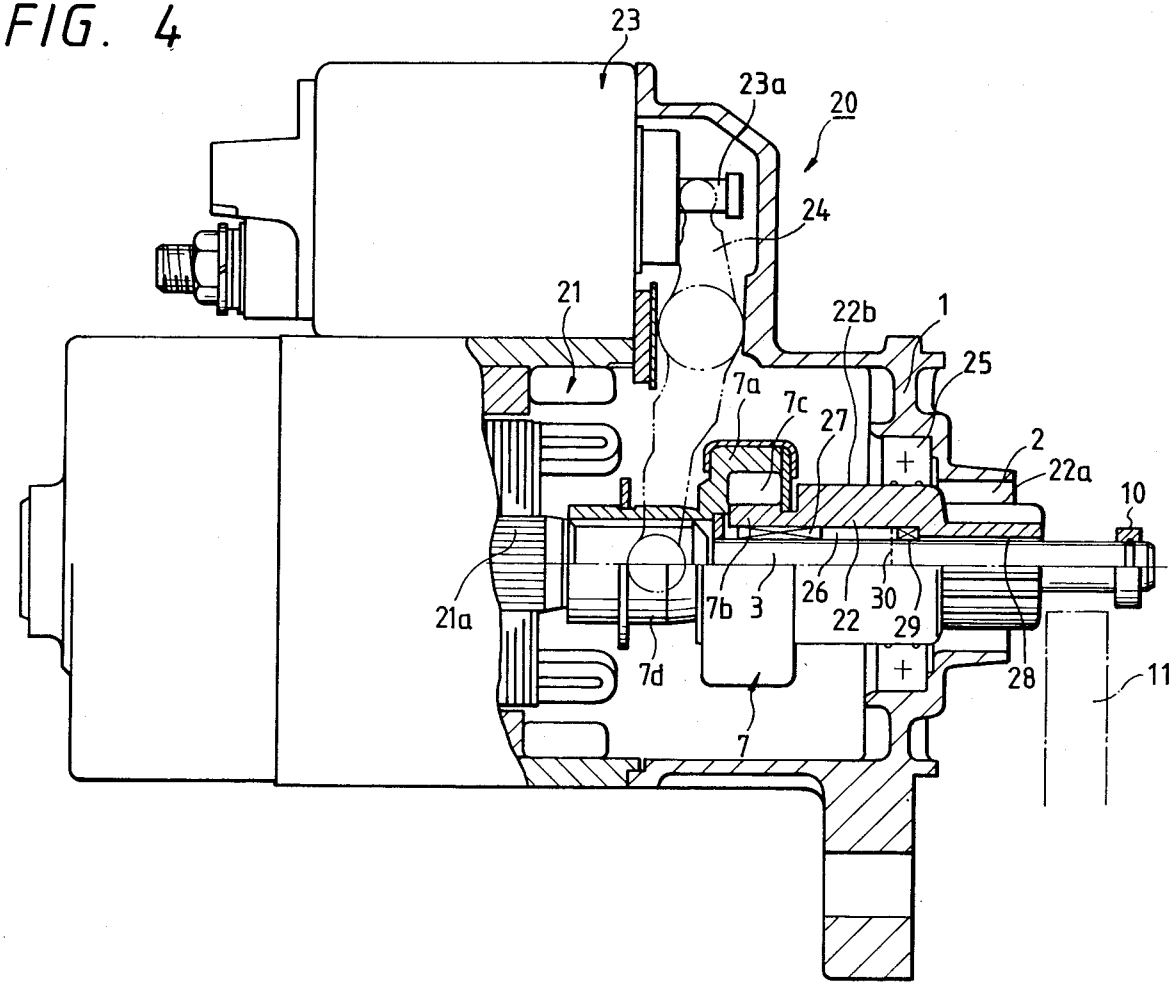
FIG. 4 is a sectional view showing a starting electric motor according to another embodiment of this invention in which a seal member 29 is provided.

In order to prevent the entrance of water or dust through the minute clearance 28, the starting electric motor shown in FIG. 4 is provided with a seal member 29 disposed in the large gap 26 at the front end. The seal member 29 is preferably an oil seal.

The position of the seal member 29 relative to the bearing 29 fitted in the gap 26 should be taken into consideration. This will be described in more detail. As was described before, when the overrunning clutch device 7 slides on the shaft extension 3 in the forward direction from its rear rest position shown in FIG. 4, the bearing 27, together with the pinion cylinder 22, is moved to its front stop position indicated at 30, where it is rotated. In this operation, the seal member 29 is also moved forwardly together with the movable pinion cylinder 22.

The bearing 27 is slid from the rear rest position to the front stop position, where it is turned, and therefore the cylindrical surface of the shaft extension 3 between the two positions is liable to become relatively rough. Therefore, if the rear rest position of the seal member 29 is in the range of slide of the bearing 29, then the sealing effect is greatly lowered by the rough surface of the shaft extension 3. Accordingly, it is preferable that the rear rest position of the seal member 29 is out of the range of side of the bearing 27. bearing 27 is fitted in the large inner cylindrical wall to support the shaft extension; that is, the inner cylindrical wall of the pinion part 22 is smaller in diameter to provide the minute clearance 28 between the inner cylindrical wall and the extension shaft. Therefore, even if the tooth form of the pinion *22a* is made smaller, or the number of teeth is reduced, the thickness of the teeth base can be sufficiently large; that is, the pinion formed is high in mechanical strength.

Figure 5:
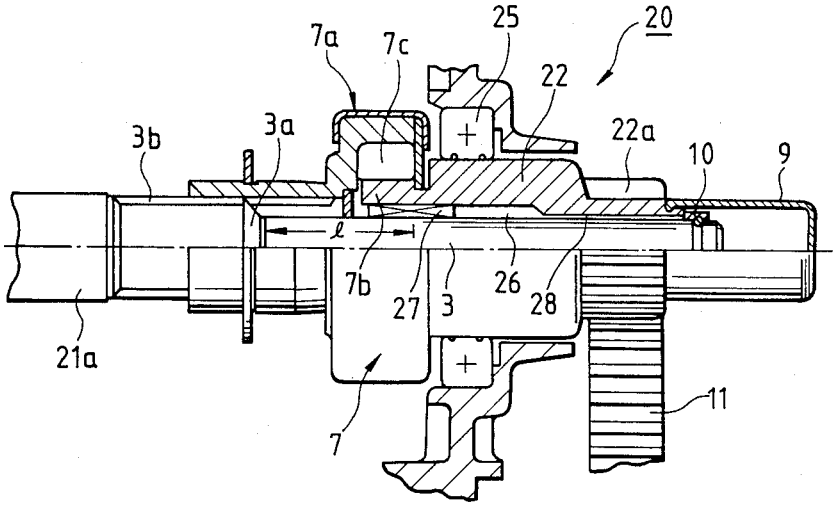
FIG. 5 is a sectional view used for explaining a starting electric motor according to this invention.

As was described above, in the starting electric motor of the invention, the inner cylindrical wall of the major part of the movable pinion cylinder, from the clutch inner part to the middle part having the slidably supporting surface, is made larger in diameter than that of the remaining minor part, so as to provide the relatively large gap between the inner cylindrical wall thereof and the cylindrical surface of the shaft extension, and with the aid of only one bearing arranged in the relatively large gap, the movable pinion cylinder is supported by and stably slid on the shaft extension. On the other hand, the inner cylindrical wall of the pinion part of the movable pinion cylinder is made smaller in diameter than that of the major part thereof so as to provide the minute clearance between the inner cylindrical wall thereof and the shaft extension. Therefore, even if Further, in the starting electric motor 20 thus constructed, when the pinion cylinder 22 is slid in the forward direction as shown in FIG. 5, the bearing 27 supporting the movable pinion cylinder 22 on the shaft extension 3 is also slid. Since, in this case, the bearing 27 is arranged in the movable pinion cylinder 22 at the rear end, the distance l between the bearing 27 thus slid and a cut-up part *3a* of a helical spline *3b* of the shaft extension 3 is much shorter than that in the case of the conventional starting electric motor in which the bearing is located at the foremost position. Accordingly, in the starting electric motor of the invention, the bending moment applied to the cut-up part *3a* of the helical spline *3b* is small. Furthermore, since the bearing 27 is fitted essentially in the inner cylindrical wall of the clutch inner part *7b*; i.e., the rear end portion of the movable pinion cylinder as was described before, the clutch inner part *7b* is scarcely off-centered in the overrunning clutch device 7, with the result that the overrunning clutch device is improved in durability.

Furthermore, in the starting electric motor 20 of the invention, the inner cylindrical wall of the rear end portion of the movable pinion cylinder is made larger in diameter than that of the front end portion, and the the tooth form of the pinion is made smaller, or the number of teeth is reduced, the thickness of the teeth base can be made sufficiently large, with the result that the pinion will not be damaged or broken.

The small clearance inside the front end portion of the movable pinion cylinder provides the labyrinth dust protective effect, and can positively prevent the removal of the applied grease which may otherwise be caused.

Furthermore, in the starting electric motor of the invention, the seal member is fitted in the gap in which the bearing is arranged, thus preventing the entrance of water or dust through the small gap between the extension shaft and the pinion part. Therefore, in the starting electric motor of the invention, unlike the conventional one, it is unnecessary to use the dust protective cap, and the total length of the starting electric motor is reduced as much. Thus, the starting electric motor can be readily installed on the engine.

As was described above, in the starting electric motor of the invention, the inner cylindrical wall of the major part of the movable pinion cylinder, from the clutch inner part to the middle part, is made larger in diameter, and only one bearing is fitted in the inner cylindrical wall, whereby the bending moment applied to the cut-up part of the helical spline of the shaft extension is considerably small. This will permit a reduction of the diameter of the shaft extension. Therefore, the thickness of the teeth base of the pinion can be increased; that is, the mechanical strength thereof can be increased.

What is claimed is:

1. A starting electric motor, comprising:

electric motor means for generating torque to start an engine, said electric motor means being provided with an armature rotary shaft having a shaft extension thereof;

overrunning clutch means axially slidably supported on said haft extension, said overrunning clutch means having a clutch outer being spline-engaged with said shaft extension;

a frame having an opening thereof for covering said electric motor;

first bearing means fixedly fitted in said frame;

movable pinion cylinder means slidably mounted on said shaft extension, said movable pinion cylinder means comprising a clutch inner part at a rear portion thereof, which forms a part of said overrunning clutch means, a pinion part at a front portion thereof, which includes a pinion formed on an outer periphery thereof, said pinion being engaged with a ring gear of said engine, and a middle part formed between said clutch inner part and said pinion part, said middle part including a slidably supporting surface at an outer periphery hereof, and being rotatably supported by said first bearing means and being slidably axially moved with respect to said first bearing means, said pinion part going in and out of said frame through said opening, wherein said movable pinion cylinder means having a first inner periphery which forms a relatively large gap between said movable pinion cylinder means and said shaft extension, said first inner periphery extending from said clutch inner part to at least a part of said middle part, and a second inner periphery extending in said pinion part and providing a minute clearance smaller than said relatively large gap; and second bearing means arranged in said relatively large gap and being slidably movable together with said movable pinion cylinder means on said shaft extension.

2. A starting electric motor as claimed in claim 1, further comprising a seal member arranged in said relatively large gap in front of said second bearing means.

3. A starting electric motor as claimed in claim 2, wherein a range in position where said seal member is slidably moved is out of a range in position where said second bearing is slidably moved.

4. A starting electric motor as claimed in claim 2, wherein said seal member is formed by an oil seal.

5. A starting electric motor as claimed in claim 3, wherein said seal member is formed by an oil seal.

6. A starting electric motor of an overhung type, comprising:

an electric motor for generating torque to start an engine, said electric motor having an armature rotary shaft with a shaft extension thereof;

an overrunning clutch device having a clutch inner part;

a front frame of said electric motor;

a first bearing fitted in said front frame;

a movable pinion cylinder with an inner periphery thereof slidably mounted on said shaft extension, which includes a pinion part at a front end thereof, said clutch inner part at a rear end thereof, and a middle portion between said pinion part and said clutch inner part with a slidably supporting surface held by said first bearing said shaft extension being supported by said front frame through said movable pinion cylinder;

a gap relatively large provided between said inner periphery of said movable pinion cylinder and said shaft extension, which extends over said clutch inner part and at least a part of said middle pinion cylinder;

a second bearing fixedly fitted in said gap in which said movable pinion cylinder is slidably and rotatably supported on said shaft extension by only said second bearing.

7. A starting electric motor as claimed in claim 6, wherein at least a part of said second bearing is positioned in said inner periphery of said clutch inner part provided at the rear end of said movable pinion cylinder.

8. A starting electric motor as claimed in claim 6, wherein a minute clearance is formed between said movable pinion cylinder and said shaft extension in said pinion part, said minute clearance being smaller than said gap.

9. A starting electric motor as claimed in claim 7, wherein a minute clearance is formed between said movable pinion cylinder and said shaft extension in said pinion part, said minute clearance being smaller than said gap.

* * * * *